US007150325B2

(12) United States Patent
Ireland et al.

(10) Patent No.: US 7,150,325 B2
(45) Date of Patent: Dec. 19, 2006

(54) ROV RETRIEVABLE SEA FLOOR PUMP

(75) Inventors: Floyd D. Ireland, Quito (EC); Janislene S. Ferreira, Rio de Janeiro (BR); Eugene E. Ratterman, Spring, TX (US); Robert J. Rivera, Tulsa, OK (US)

(73) Assignee: Baker Hughes Incorporated, Houston, TX (US)

( * ) Notice: Subject to any disclaimer, the term of this patent is extended or adjusted under 35 U.S.C. 154(b) by 322 days.

(21) Appl. No.: 10/627,859

(22) Filed: Jul. 25, 2003

(65) Prior Publication Data

US 2005/0016735 A1 Jan. 27, 2005

(51) Int. Cl.
*E21B 29/12* (2006.01)
*E21B 43/12* (2006.01)

(52) U.S. Cl. ..... 166/366; 166/69; 166/107; 166/109

(58) Field of Classification Search ..... 166/366, 166/352, 69, 107–109, 358
See application file for complete search history.

(56) References Cited

U.S. PATENT DOCUMENTS 3,261,398 A 7/1966 Haeber
3,412,789 A 11/1968 Ralph et al.
3,638,732 A * 2/1972 Huntsinger et al. ..... 166/379
4,331,203 A 5/1982 Kiefer
4,643,616 A 2/1987 Castel et al.
4,979,880 A 12/1990 Delaittre
5,280,766 A 1/1994 Mohn
5,795,135 A 8/1998 Nyilas et al.
5,871,051 A 2/1999 Mann
5,954,483 A 9/1999 Tetzlaff
6,059,539 A 5/2000 Nyilas et al.
6,068,427 A 5/2000 Østergaard
6,488,093 B1 12/2002 Moss
6,688,392 B1 2/2004 Shaw

* cited by examiner

*Primary Examiner*—David Bagnell
*Assistant Examiner*—Giovanna M. Collins
(74) *Attorney, Agent, or Firm*—Bracewell & Giuliani LLP

(57) ABSTRACT

A subsea pumping assembly locates on a seafloor for pumping well fluid from subsea wells to the level. The pumping assembly has a tubular outer housing that is at least partially embedded in the seafloor. A tubular primary housing locates in the outer housing and has a lower end with a receptacle. An annular space surrounds the primary housing within the outer housing for delivering fluid to a receptacle at the lower end of the primary housing. A capsule is lowered in and retrieved from the primary housing. The capsule sealingly engages the receptacle for receiving well fluid from the annular space. A submersible pump is located inside the capsule. The pump has an intake that receives well fluid and a discharge that discharges the well fluid exterior of this capsule. The capsule has a valve in its inlet that when closed prevents leakage of well fluid from the capsule. The capsule may be retrieved through open sea without a riser.

19 Claims, 3 Drawing Sheets

ROV RETRIEVABLE SEA FLOOR PUMP

FIELD OF THE INVENTION

This invention relates in general to subsea well production and in particular to a pump system for location on the sea floor.

BACKGROUND OF THE INVENTION

Subsea wells typically connect to a subsea manifold that delivers the well fluid to a production platform for processing, particularly for the removal of water and gas. The oil is then transmitted to a pipeline or other facility for export from the production platform. Production of fluids from a medium to deep subsea environment requires compensation for the effects of cold temperatures, high ambient pressures and fluid viscosity as a function of break out of gas in the fluid stream. In flowing wells, particularly those with light API fluid, these conditions may be mitigated by the nature of the producing reservoir. In wells with low API oil and insufficient pressure to drive the fluid to the surface, some form of artificial lift will be required.

One type of artificial lift for wells employs an electrical submersible pump, which is a type that has been used for many years on land based wells. An electrical submersible pump typically has an electrical motor, a rotary pump and a seal section located between the pump and the motor for equalizing hydrostatic fluid pressure with the internal pressure of lubricant in the motor. These types of pumps must be retrieved periodically for repair or replacement due to normal wear, as often as every eighteen months.

Pulling a pump to replace it normally requires a workover rig, because most pumps are suspended on strings of tubing. Pulling production tubing on an offshore well is much more expensive than a land-based or surface wellhead. An intervention to remove the pump of an offshore well must be scheduled months in advance, depending on the production method. The cost, coupled with lost production, will in some cases make large potential reservoirs non-economical.

There have been proposals to utilize pumps at the seafloor to pump the well fluid flowing from the well to the sea floor level. A number of problems are associated with the task, including periodically replacing the pump from the seafloor without the need for an expensive workover or drilling rig. One factor to consider is that the sea cannot be polluted with well fluid, thus traditionally risers have been employed during drilling and intervention operations that shield sea water from well components as they are pulled to the surface. If a riser must be employed to remove and replace a seafloor or mudline pump, a workover rig must still be employed at a great expense.

SUMMARY OF THE INVENTION

In this invention, a mudline or seafloor pump system is employed that allows retrieval of the pump without the use of a riser. A primary housing is located subsea at seafloor. The primary housing communicates with an intake conduit for receiving well fluid from an adjacent well or wells. A capsule lands in the primary housing and has an inlet that sealingly engages the receptacle of the primary housing for receiving well fluid flowing through the primary housing. A submersible pump assembly is located inside the capsule. The pump assembly has an intake that receives well fluid from the capsule and discharges the well fluid from the capsule. The capsule is retrievable from the primary housing through the open sea. Since only its interior is exposed to well fluid, the capsule avoids pollution of well fluid with the sea.

In a preferred embodiment, the intake conduit comprises a caisson or outer housing that is at least partially embedded in the seafloor. The primary housing, which is also tubular, lands in the outer housing. Well fluid from adjacent wells flows down an annular space between the primary housing and the outer housing of the receptacle.

DETAILED DESCRIPTION OF THE PREFERRED EMBODIMENT

Figure 1:
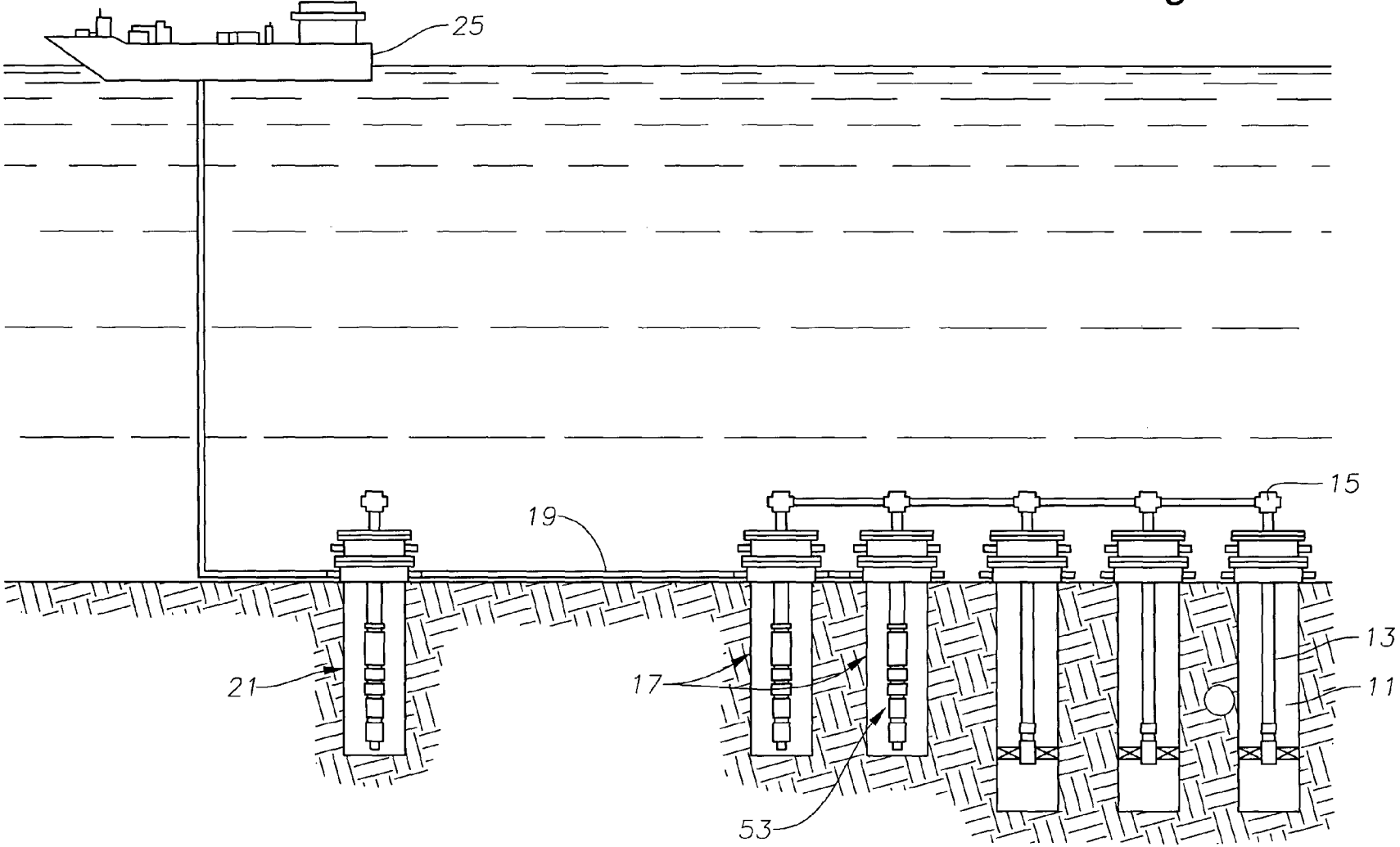
FIG. 1 is a schematic view illustrating a subsea well pumping system in accordance with this invention.

Referring to FIG. 1, a plurality of subsea wells 11 are schematically shown. The system of FIG. 1 is particularly suitable for medium to deep water subsea wells, wherein the water depth comprises at least 60% of the distance from the earth reservoir or perforations in the well to sea level. Subsea wells 11 may be a variety of types. Each shows a production tubing 13 suspended within a casing that is perforated for the flow of well fluid. Wells 11 are shown to be a type having a flowing pressure sufficient to flow well fluid from the perforations to the surface of each well 11 at the seafloor. A plurality of jumper flowlines 15 connect the various wells 11. Wells 11 are routed to a pumping assembly 17 directly or through a manifold (not shown).

Pumping assembly 17 is also located at the mudline on the seafloor. In this example, pumping assembly 17 comprises two separate redundant pumping assemblies that are connected in parallel so that one can be removed for replacement or repair while the other continues to operate. However, a single pumping assembly 17 is also feasible. Pumping assembly 17 is connected to a flowline 19 that leads to an optional booster pumping system 21.

Booster pumping system 21 is shown to be identical to the two primary pumping assemblies 17, and in the event pumping assemblies 17 provide adequate pressure, would not be needed. A production riser 23 extends from booster pumping assembly 21 to production platform 25. Production platform 25 is a vessel that contains production equipment for separating water and gas from the oil. Production platform 25 has an export line (not shown) for delivering the processed well fluid to tankers or a production pipeline.

Figure 2:
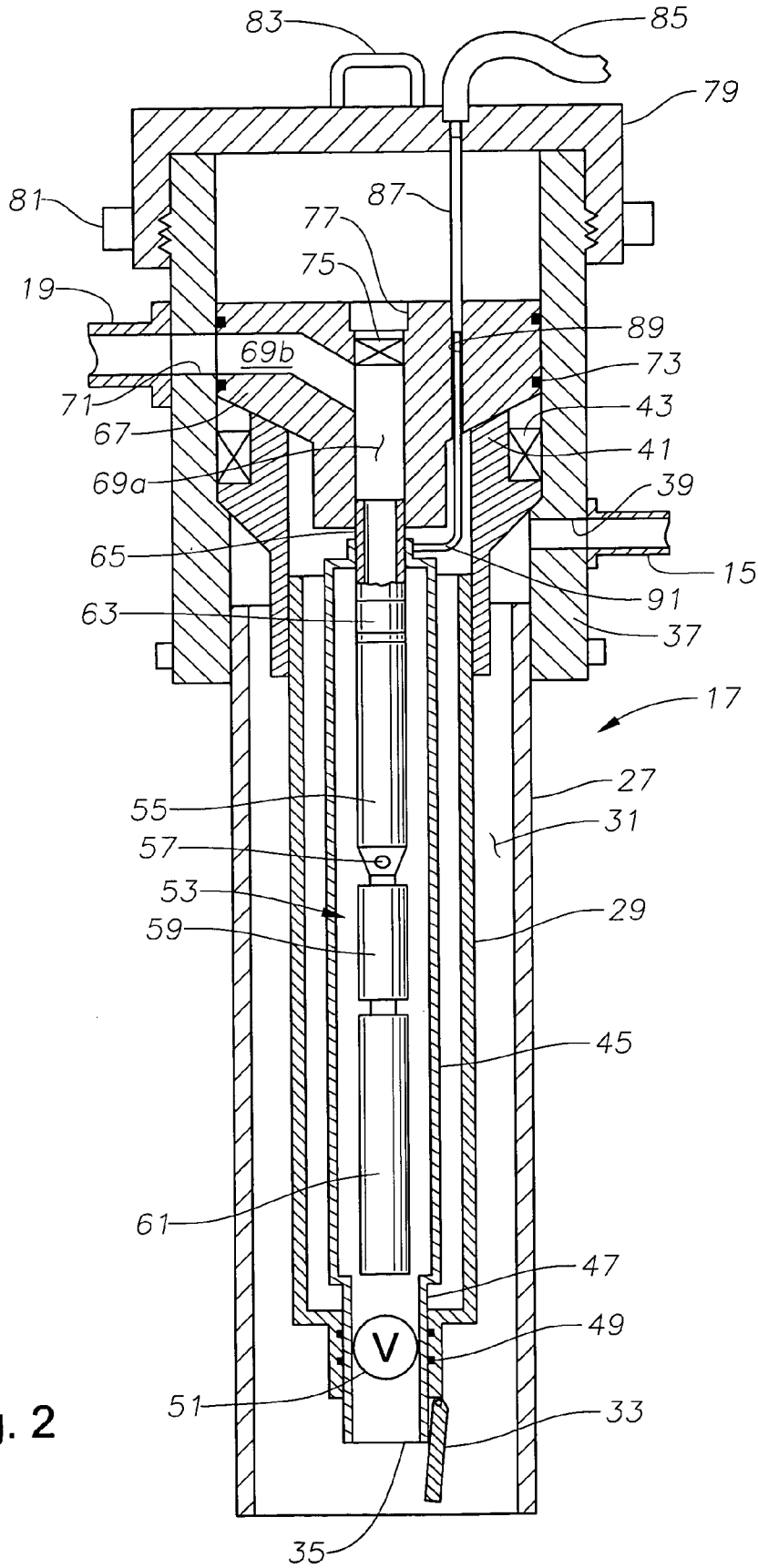
FIG. 2 is an enlarged sectional and schematic view of one of the pumping assemblies of FIG. 1.

Referring to FIG. 2, each pumping assembly 17 or 21 has outer housing 27 that comprises a caisson or can. Outer housing 27 is a tubular section of pipe that is closed at its lower end and embedded into the seafloor for a depth sufficient to house the pumping components, generally less than 100 feet. A primary housing 29 lands and is supported in outer housing 27. Primary housing 29 is a tubular member made up of sections of casing. The outer diameter of primary housing 29 is substantially less than the inner diameter of housing 27, defining an annular space 31 between them. Primary housing 29 has a receptacle 33 on its lower end. Receptacle 33 is a polished bore having a receptacle valve 35, which may be either a sliding sleeve or flapper valve type. When closed, well fluid in annular space 31 is blocked from passing into the interior of primary housing 29.

Outer housing 27 includes a head 37 at its upper end. Head 37 is preferably a tubular member of larger diameter than housing 27 and resembles a wellhead. Head 37 has an inlet port 39 that is connected to one of the flowline jumpers 15 for receiving well fluid to flow into annular space 31.

Primary housing 29 is supported within head 37 by a primary housing hanger 41. Hanger 41 is similar to a casing hanger, having a portion that lands on a shoulder formed in head 37. A seal 43 seals the exterior of primary housing hanger 41 to the interior of head 37. Hanger 41 blocks any flow of well fluid upward past primary housing hanger 41.

A capsule 45 is retrievably landed in primary housing 29. Capsule 45 is a tubular, sealed shroud with a tail pipe 47 on its lower end. Tail pipe 47 has seals 49 on its exterior that slidingly engage polished bore of receptacle 33 to seal within receptacle 33. Tail pipe 47 also actuates receptacle valve 35 to open receptacle valve 35 as it lands. When tail pipe 47 is not located in receptacle 33, receptacle valve 35 will automatically close. The inlet to capsule 45 is through tail pipe 47. A valve 51 is located in the inlet. Valve 51 may be a check valve that allows upward flow into the interior of capsule 45, but blocks downward flow.

An electrical submersible pump 53 is located within capsule 45. Electrical submersible pump 53 may either be of a centrifugal type, progressing cavity type or some other type. In this embodiment, pump 55 is a centrifugal type having a large number of stages, each stage having an impeller and a diffuser. Pump 55 has an intake 57 at its lower end that is spaced above receptacle 33. Seal section 59 secures to the lower end of pump 55. An electrical motor 61 is secured to the lower end of seal section 59. Seal section 59 equalizes the hydrostatic pressure on the motor exterior with the internal lubricant pressure within motor 61. Seal section 59 also has a thrust bearing for accommodating down thrust from pump 55. The lower end of motor 61 is located near the lower end of capsule 45 and above tail pipe 47.

An adapter 63 connects to upper end of pump 55 to a sub 65 that is secured to the lower end of a capsule hanger 67. Adapter 63 and sub 65 could comprise a single member. Alternately, pump 55 could be directly connected to capsule hanger 67. Capsule 45 has an upper end that sealingly connects to a portion of ESP 53 above intake 57. In the embodiment shown, the upper end of capsule 45 is shown sealingly engaging sub 65.

Capsule hanger 67 resembles a tubing hanger of a well. It either lands on a shoulder in head 37 or it may land on the upper end of casing hanger 41 as shown. Capsule hanger 67 has a vertical production passage 69*a* that extends upward from sub 65. Vertical production passage 69*a* joins a lateral passage 69*b* that leads to the exterior. In this embodiment, capsule hanger 67 is rotationally oriented so that production passage 69 aligns with an outer port 71 that leads to flowline 19. Seals 73 are located above and below lateral production passage 69*b* to seal lateral passage 69*b* to head 37 above and below outlet port 71. A plug 75, which may be installed on a wireline, locks in a profile in the upper portion of production passage 69*a* above lateral production passage 69*b*. Capsule hanger 67 has a running tool profile 77, which in this embodiment is located in the upper end of vertical passage 69*a*.

A cap 79 secures to the upper end of head 37. Cap 79 has a plurality of dogs 81 on its exterior that are actuated by an ROV (not shown) to secure cap 79 to the upper end of head 37. Dogs 81 could be actuated hydraulically through hydraulic power supplied by the ROV or could be the type that are mechanically rotated between open and closed positions. Other types of retainers could be used to retain cap 79 on outer housing 37. Cap 79 could be sealed to head 37, but it is not necessary because plug 75 and seals 73 block any well fluid from the interior of head 37 above capsule hanger 67. Consequently, cap 79 could be similar to a debris cap that is employed on wellhead housings or trees of certain installations. A handle 83 on the upper side of cap 79 facilitates removal by an ROV.

In this embodiment, a power cable 85 is shown extending through the upper end of cap 79. Power cable 85 has a penetrator rod 87 for each conductor, normally three. Penetrator rods 87 extend into receptacles 89 located in the upper end of capsule hanger 67. Consequently, cap 79 must be oriented when installed in this embodiment. A motor lead 91 (not shown in full) extends from the lower end of each penetrator receptacle 89 down to motor 61. As an alternative to the penetrators 87, power cable 85 could be installed laterally through head 37 into a wet mate engagement with a receptacle formed in the side wall of capsule hanger 67. In that event, an ROV would provide hydraulic power to extend and retract the connectors in engagement with capsule hanger 67.

Figure 3A:
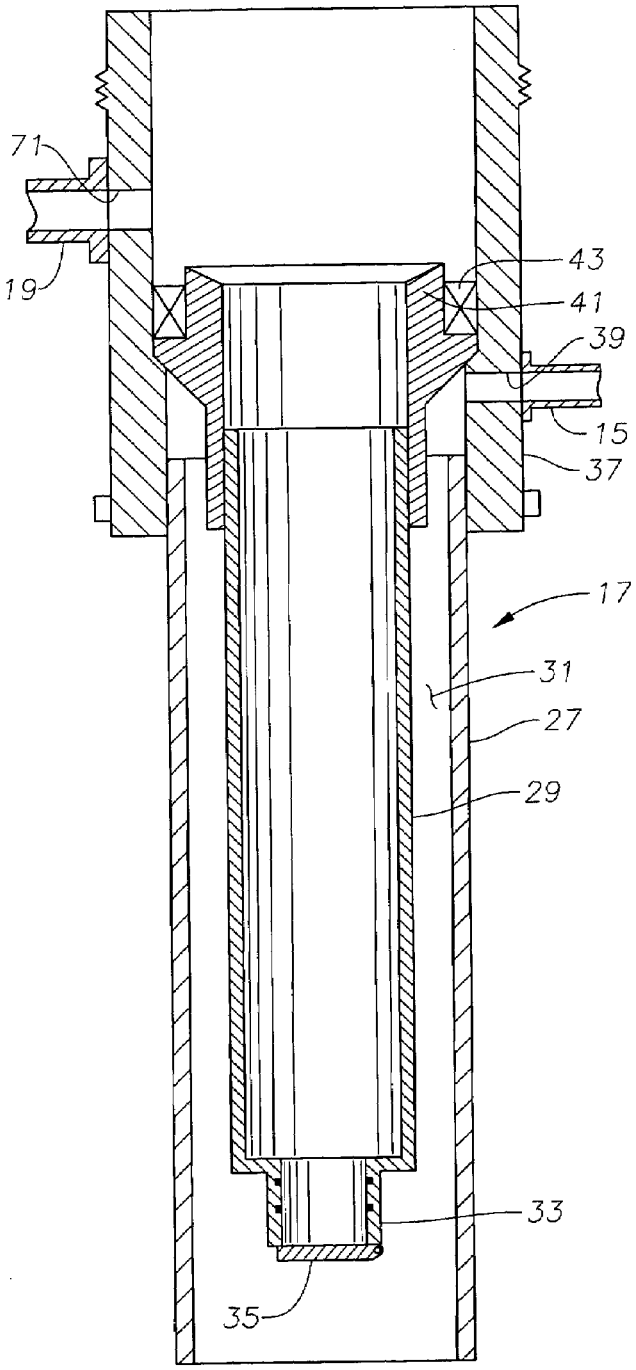
FIG. 3A is a sectional view of the pumping assembly of FIG. 2 with the capsule and pump removed.
Figure 3B:
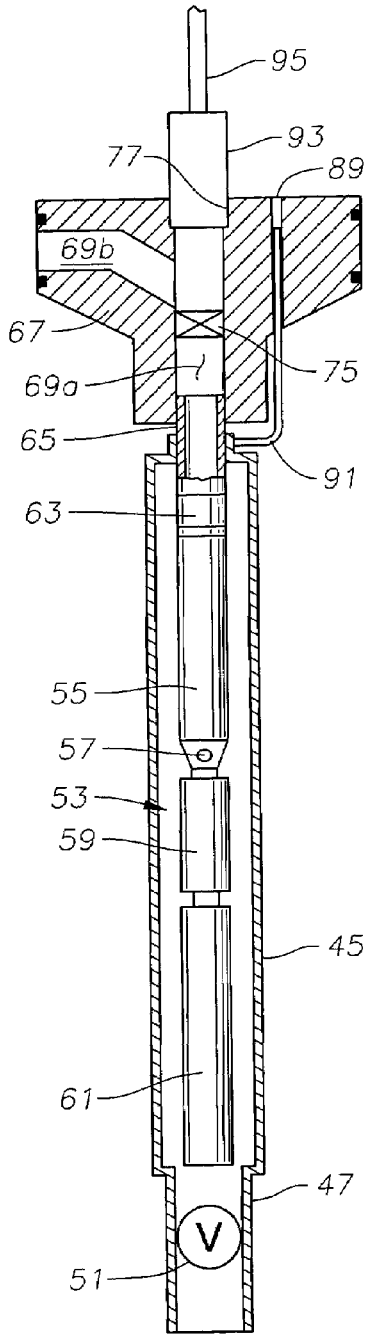
FIG. 3B is a sectional view of the capsule and pump for the pumping assembly of FIG. 2 being lowered on a lift line.

In explanation of the operation, FIG. 3A shows primary housing 29 prior to installation of capsule 45, which is shown in FIG. 3B. Receptacle valve 35 is closed and cap 79 is shown removed. Valves (not shown) from flowline jumper 15 block flow from wells 11 (FIG. 1). The operator connects a running tool 93 to profile 77 in capsule hanger 67 as shown in FIG. 3B. Running tool 93 releasably engages capsule hanger 67 and is secured to a lift line 95. Lift line 95 is preferably lowered from a winch on a vessel at the surface. Plug 75 is shown located in a lower position below lateral production passage 69*b*, however, if pump assembly 53 is clean and the interior of capsule 45 free of any oil, plug 75 could be in the upper position of FIG. 2.

An ROV will guide capsule 45 into primary housing 29, landing capsule 45 on primary housing hanger 41. As it lands, capsule tail pipe 47 opens valve 35. Capsule hanger seal 73 will sealingly engage the bore of head 37 above and below outlet port 71. Seals 73 are illustrated schematically to be passive seals. Alternately, the upper seal 73 could be an active seal that is energized by a sleeve of running tool 93. Once landed, running tool 93 will be released from profile 77 with the assistance of the ROV, which typically supplies either hydraulic or mechanical power to cause running tool 93 to release. If plug 75 is in the lower position of FIG. 3*b* below lateral production port 69*b*, a wireline tool is attached to lift line 95 and used to reset wireline plug 75 in the upper position of FIG. 2. The operator then uses the ROV to pick up cap 79 in (FIG. 2), which has been positioned in a staging position, and secures it on head 37. The operator uses the ROV to secure cap 79 to head 37 with dogs 81. This may be done either with hydraulic power or mechanical. As the operator installs cap 79, penetrator rods 87 (FIG. 2) are sealingly engaged in mating engagement with penetrator receptacles 89 in capsule hanger 67. The operator retrieves running tool 93 on lift line 95 as well as retrieving the ROV.

The operator turns on the valves in flowline jumpers 15 to supply well fluid to port 39, the well fluid flowing down annulus space 31 to receptacle 33 and into capsule 45. As the well fluid flows up to pump intake 57, it flows over motor 61 and seal section 59 to provide cooling to motor 61 and to the thrust bearings in seal section 59. Pump 55 discharges the well fluid through production passage 69*b*, outlet port 71 and into flowline 19, where it flows either to booster pump 21 (FIG. 1) or directly to riser 23 and to production platform 25.

When ESP 53 (FIG. 2) must be changed, the operator reverses the process described above. With the use of an ROV and lift line 95, the operator will remove cap 79. The operator uses a wireline retrieval tool, typically on lift line 95, to move plug 75 from the upper position to the lower position shown in FIG. 3B below passage 69*a*, thereby sealing the well fluid contained in capsule 45 from any leakage to the exterior. The operator then lifts the capsule 45 on lift line 95 with running tool 93 and pulls it through the open sea to the surface. Pollution does not occur because the exterior of capsule 45 has not been exposed to well fluid. The interior of capsule 45 is sealed by plug 75 and valve 51. If necessary, a pressure compensator could equalize hydrostatic pressure of sea water on the exterior of capsule 45 with the interior. The operator then repeats the process described above to rerun capsule 45.

The invention has significant advantages. The pumping system provides pressure to pump from a mudline level to a surface level in moderate to deep water. This system may avoid abandoning oil fields that lack sufficient pressure to produce fluid to sea level. The pump assembly is installed at the mudline without the need for a workover rig or a riser. The pumping system allows the pump to be retrieved for repair or replacement at a much lower cost than if a workover rig were required.

While the invention has been shown only in one of its forms, it should be apparent to those skilled in the art that it is not so limited but susceptible to various changes without departing from the scope of the invention. For example, the pump could be oriented to discharge downward rather than upward. The outer housing, which serves as an intake conduit for the primary housing, could comprise a manifold located at an upper end of primary housing rather than completely surrounding the housing as in the preferred embodiment.

The invention claimed is:

1. A subsea pumping assembly, comprising:

a primary housing adapted to be located subsea, the primary housing having an open first end and a second end containing a receptacle of smaller inner diameter than an inner diameter of the open first end;

an intake conduit in fluid communication with the receptacle for supplying well fluid;

a capsule that is installed through the open first end and lands in the primary housing, the capsule having an inlet that sealingly engages the receptacle as the capsule lands for receiving well fluid flowing through the intake conduit into the receptacle and the inlet of the capsule;

a submersible pump assembly located in the capsule, the pump assembly having an intake for receiving well fluid flowing into the capsule and a discharge for discharging the well fluid from the capsule; and wherein the capsule while containing the pump assembly therein is retrievable from the primary housing.

2. The pumping assembly according to claim 1, wherein the inlet of the capsule comprises a tail pipe that stabs sealingly into the receptacle as the capsule lands in the primary housing.

3. The pumping assembly according to claim 1, further comprising a capsule valve at the inlet of the capsule that prevents well fluid in the capsule from leaking out the capsule when the capsule is removed from the primary housing.

4. The pumping assembly according to claim 1, wherein the pump assembly comprises a rotary pump and an electrical motor, and wherein the intake of the pump is spaced from the inlet of the capsule to cause the well fluid to flow over the motor as it flows from the inlet of the capsule to the intake of the pump.

5. The pumping assembly according to claim 1, wherein the intake conduit comprises an outer housing that encloses the primary housing, defining a space between the outer housing and the primary housing for the flow of well fluid from the intake conduit to the receptacle.

6. The pumping assembly according to claim 1, wherein:

the intake conduit comprises a tubular outer housing at least partially embedded in a sea floor; and the primary housing is a tubular member concentrically located in the outer housing, defining an annular space between the primary housing and the outer housing for the flow of well fluid.

7. The pumping assembly according to claim 1, further comprising:

a removable cap mounted to an upper end of the primary housing; and a lifting profile on the capsule for engagement by a lift line lowered from a vessel at the surface.

8. The pumping assembly according to claim 1, wherein the sealing engagement of the inlet of the capsule with the receptacle prevents the entry of well fluid into the primary housing.

9. The pumping assembly according to claim 1, wherein the intake conduit for the receptacle is located above the receptacle.

10. A subsea pumping assembly, comprising:

a primary housing adapted to be located subsea, the primary housing having a lower end with a receptacle;

an intake conduit connected with the receptacle for supplying well fluid from a well;

a capsule that lands in the primary housing, the capsule having an inlet that sealingly engages the receptacle for receiving well fluid;

a submersible pump assembly located in the capsule, the pump assembly having an intake for receiving well fluid flowing into the capsule and a discharge for discharging the well fluid from the capsule; and wherein the capsule while containing the pump assembly therein is retrievable from the primary housing; and a receptacle valve at the receptacle for blocking the flow of well fluid from the intake conduit into the receptacle when the capsule is removed from the primary housing.

11. A subsea pumping assembly, comprising:

a tubular outer housing at least partially embedded in a sea floor;

a tubular primary housing located in the outer housing and having a lower end with a receptacle, the primary housing having an outer diameter smaller than an inner diameter of the outer housing, defining an annular space that is adapted to receive well fluid flowing from a well;

a capsule that lands in and is retrievable from the primary housing, the capsule having an inlet on a lower end that sealingly engages the receptacle for flowing well fluid from the annular space into the capsule, the exterior of the capsule being sealed from exposure to the well fluid by the primary housing;

a submersible pump assembly located in the capsule, the pump assembly having an intake for receiving well fluid flowing into the capsule and a discharge for discharging the well fluid exterior of the capsule; and a capsule valve in the inlet of the capsule that when closed prevents leakage of well fluid from the capsule, enabling the capsule to be retrieved through the sea without a riser.

12. The pumping assembly according to claim 11, further comprising a receptacle valve at the receptacle for blocking the flow of well fluid from the outer housing into the receptacle when the capsule is removed from the primary housing.

13. The pumping assembly according to claim 11, wherein the inlet of the capsule comprises a tail pipe that extends slidingly into the receptacle.

14. The pumping assembly according to claim 11, wherein the pump assembly comprises a rotary pump and an electrical motor, and wherein the pump intake is spaced from the inlet of the capsule to cause the well fluid to flow over the motor as it flows from the inlet of the capsule to the intake of the pump.

15. A method of pumping well fluid from a sea floor to a surface platform, comprising:

(a) installing a primary housing at the sea floor at a location remote from a producing well;

(b) placing a submersible pump assembly in a capsule; then (c) lowering the capsule from the surface into the primary housing while the pump assembly is contained therein and sealingly engaging an inlet of the capsule with a receptacle of the primary housing; then (d) flowing well fluid from the producing well into the receptacle, through the inlet and into the capsule and pumping the well fluid from the capsule with the pump assembly.

16. The method according to claim 15, wherein:

step (a) further comprises at least partially embedding a tubular outer housing in the sea floor and landing the primary housing in the sea floor; and step (d) further comprises:

flowing the well fluid down an annular space between the primary housing and the outer housing to the receptacle.

17. The method according to claim 15, wherein step (b) comprises connecting a rotary pump to an electrical motor and positioning the pump and motor such that well fluid in the capsule flows over the motor for cooling the motor as it flows from the inlet of the capsule to an intake of the pump.

18. The method according to claim 15, wherein the sealing engagement of the inlet of the capsule with the receptacle prevents the entry of well fluid into the primary housing.

19. A method of pumping well fluid from a sea floor to a surface platform, comprising:

(a) installing a primary housing at the sea floor;

(b) placing a submersible pump assembly in a capsule; then (c) lowering the capsule from the surface into the primary housing while the pump assembly is contained therein and sealingly engaging an inlet of the capsule with a receptacle of the primary housing; then (d) flowing well fluid into the receptacle, through the inlet and into the capsule and pumping the well fluid from the capsule with the pump assembly; and retrieving the capsule for maintenance to the pump assembly by closing a valve at the inlet of the capsule, and retrieving the capsule on a lift line through the open sea, the primary housing preventing exposure of well fluid to the exterior of the capsule.

* * * * *